US009947338B1

(12) United States Patent
Koteshwara et al.

(10) Patent No.: US 9,947,338 B1
(45) Date of Patent: Apr. 17, 2018

(54) ECHO LATENCY ESTIMATION

(71) Applicant: Amazon Technologies, Inc., Seattle, WA (US)

(72) Inventors: Krishna Kamath Koteshwara, Santa Clara, CA (US); Trausti Thor Kristjansson, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/708,772

(22) Filed: Sep. 19, 2017

(51) Int. Cl.

| | |
|---|---|
| ***G10L 21/0232*** | (2013.01) |
| ***H04S 3/00*** | (2006.01) |
| ***H04S 7/00*** | (2006.01) |
| ***H04R 5/02*** | (2006.01) |
| *G10L 21/0208* | (2013.01) |

(52) U.S. Cl.
CPC ..... *G10L 21/0232* (2013.01); *H04R 5/02* (2013.01); *H04S 3/008* (2013.01); *H04S 7/301* (2013.01); *G10L 2021/02082* (2013.01)

(58) Field of Classification Search
CPC ..... G10L 2021/02082; G10L 21/0208; G10L 19/26; G10L 19/265; G10L 19/0204; G10L 21/028
See application file for complete search history.

(56) References Cited

U.S. PATENT DOCUMENTS

| | | | | |
|---|---|---|---|---|
| 2006/0002547 | A1* | 1/2006 | Stokes | H04M 9/082 379/406.14 |
| 2009/0248403 | A1* | 10/2009 | Kinoshita | H04N 7/147 704/219 |
| 2012/0201370 | A1* | 8/2012 | Mazurenko | H04M 9/082 379/406.1 |
| 2014/0169568 | A1* | 6/2014 | Li | H04M 9/082 381/17 |
| 2015/0371654 | A1* | 12/2015 | Johnston | H04M 9/082 381/66 |
| 2015/0371659 | A1* | 12/2015 | Gao | G10L 21/0208 704/226 |
| 2016/0044394 | A1* | 2/2016 | Derom | H04R 1/00 367/95 |
| 2017/0092256 | A1* | 3/2017 | Ebenezer | G10K 11/175 |
| 2017/0208391 | A1* | 7/2017 | Shah | H04R 3/02 |

* cited by examiner

*Primary Examiner* — Mohammad Islam
(74) *Attorney, Agent, or Firm* — Pierce Atwood LLP

(57) ABSTRACT

A device that determines an echo latency estimate by combining reference signals. The device may determine the echo latency corresponding to an amount of time between reference signals being sent to transmitters and input data corresponding to the reference signals being received. The device may generate a combined reference signal by adding (or filtering) each of the reference signals. The device may then compare the combined reference signal to input audio data received from a microphone or receiving device. The device may detect a highest peak, determine if there are any earlier significant peaks and estimate the echo latency based on the earliest significant peak. This technique is not limited to audio data and may be used for signal matching using any system that includes multiple transmitters and receivers (e.g., Radar, Sonar, etc.).

20 Claims, 10 Drawing Sheets

ECHO LATENCY ESTIMATION

BACKGROUND

Systems may detect a delay or latency between when a reference signal is transmitted and when an "echo" signal (e.g., input audio data corresponding to the reference signal) is received. In audio systems, reference signals may be sent to loudspeakers and a microphone may recapture portions of the reference signal as the echo signal. In Radar or Sonar systems, a transmitter may send radio waves or sound waves and a receiver may detect reflections (e.g., echoes) of the radio waves or sound waves.

BRIEF DESCRIPTION OF DRAWINGS

For a more complete understanding of the present disclosure, reference is now made to the following description taken in conjunction with the accompanying drawings.

DETAILED DESCRIPTION

Devices may perform signal matching to determine an echo latency between when a reference signal is transmitted and when an echo signal is received. The echo latency corresponds to a time difference between the reference signal and the echo signal and may indicate where the portions of the reference signal and the echo signal are matching. When multiple reference signals are sent to multiple transmitters, some devices may determine the echo latency using cross-correlations between individual reference signals and the echo signal. However, when the reference signals are highly correlated, this technique may not work and the devices may be unable to determine the echo latency.

To improve echo latency estimation, offered is a device that combines reference signals and determines the echo latency estimate based on a cross-correlation between the combined reference signals and the echo signal. The device may generate a combined reference signal by adding (or filtering) each of the reference signals. The device may then compare the combined reference signal to input audio data received from a microphone or receiving device. The device may detect a highest peak, determine if there are any earlier significant peaks and estimate the echo latency based on the earliest significant peak. This technique is not limited to audio data and may be used for signal matching using any system that includes multiple transmitters and receivers.

Figure 1:
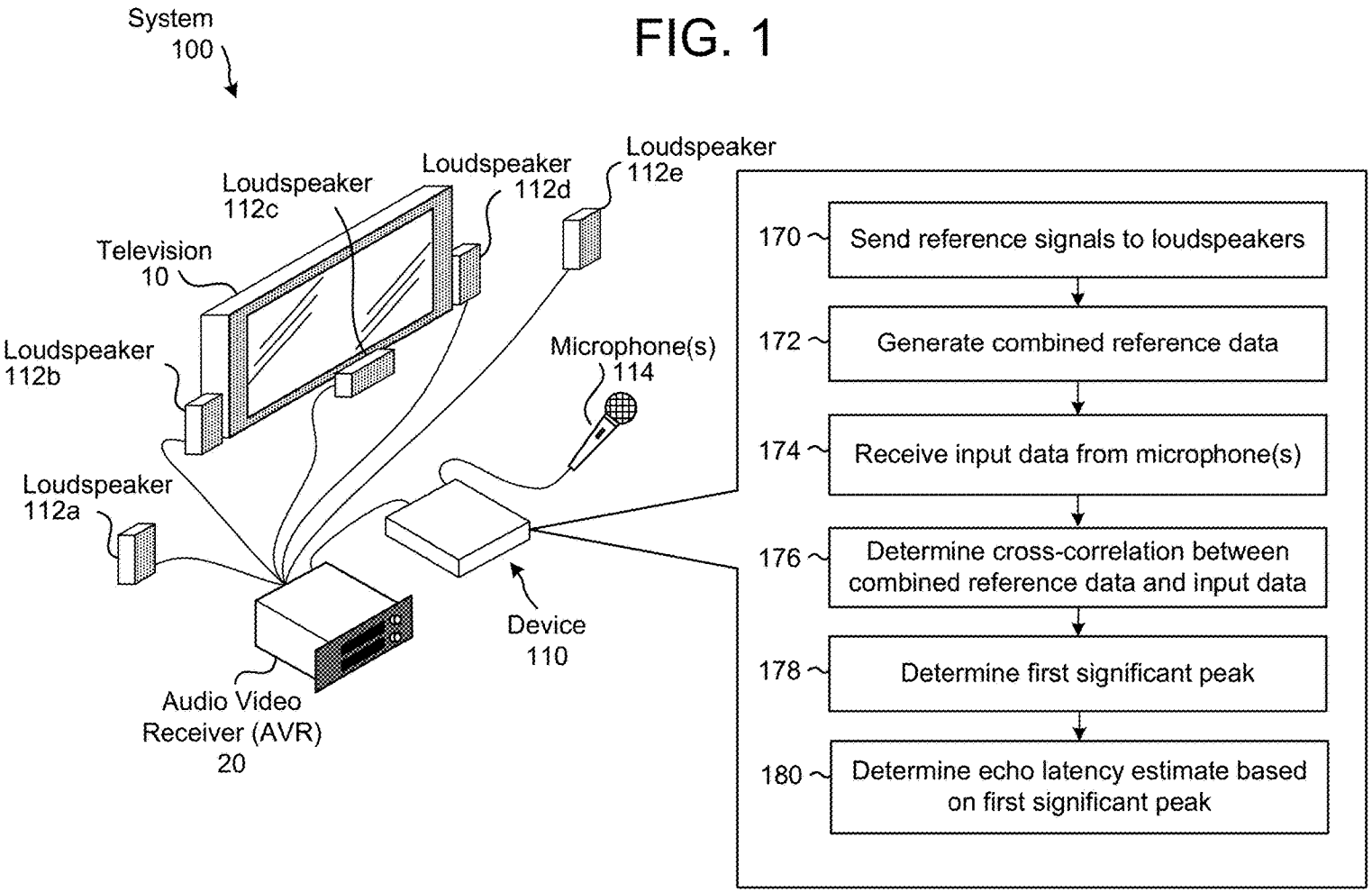
FIG. 1 illustrates a method for determining an echo latency estimate according to embodiments of the present disclosure.

FIG. 1 illustrates a method for determining an echo latency estimate according to embodiments of the present disclosure. As illustrated in FIG. 1, a system 110 may include a device 110, one or more loudspeaker(s) 112 and one or more microphone(s) 114. The system 110 illustrated in FIG. 1 also includes a television 10 and an audio video receiver (AVR) 20 that are associated with the loudspeaker(s) 112, although the disclosure is not limited thereto. As illustrated in FIG. 1, the device 110 may be connected to the loudspeaker(s) 112 via the AVR 20, which may perform additional audio processing to audio data prior to sending the audio data to the loudspeaker(s) 112. For example, the device 110 may send first reference audio signals to the AVR 20 and the AVR 20 may generate second reference audio signals and send the second reference audio signals to the loudspeaker(s) 112. The AVR 20 may perform any audio processing, including changing a number of channels, upmixing/downmixing the reference audio signals, and/or other techniques known to one of skill in the art. Thus, the AVR 20 may introduce variable, nonlinear delays between when the device 110 sends the audio data to the AVR 20 and when the loudspeaker(s) 112 receive the audio data.

While FIG. 1 illustrates the device 110 connected to the AVR 20, this is intended for illustrative purposes only and the disclosure is not limited thereto. Instead, the device 110 may be connected to any external device, including the television 10 or the like, without departing from the disclosure. Additionally or alternatively, the device 110 may connect directly to one or more loudspeaker(s) 112 without departing from the disclosure.

While FIG. 1 illustrates the AVR 20, the loudspeakers 112, the microphone(s) 114, and the device 110 connected via a wired connection, this is intended for illustrative purposes only and the disclosure is not limited thereto. Instead, the device 110, the AVR 20, the loudspeakers 112, and/or the microphone(s) 114 may communicate using a wired and/or wireless connection without departing from the disclosure. Additionally or alternatively, the loudspeaker(s) 112 and/or the microphone(s) 114 may be included in the device 110 without departing from the disclosure.

In the system 100 illustrated in FIG. 1, the echo latency estimate corresponds to an amount of time required for audio generated by the loudspeaker(s) 112 to travel to the microphone(s) 114. As will be described in greater detail below, the system 100 may send reference signal(s) to the loudspeaker(s) 112 and may detect audio corresponding to the reference signal(s) represented in input audio data generated by the microphone(s) 114. Thus, after a delay corresponding to the echo latency, the microphone(s) 114 may capture the audio output by the loudspeaker(s) 112.

While FIG. 1 illustrates the device 110 sending the reference signals to five loudspeakers (e.g., loudspeakers 112*a*-112*e*), the disclosure is not limited thereto. Instead, the device 110 may send the reference signals to any number of loudspeakers 112 without departing from the disclosure. For example, the device 110 may send reference signals to two loudspeakers 112 (e.g., stereo), five loudspeakers 112 (e.g., surround sound audio), six loudspeakers 112 (e.g., 5.1 surround sound), seven loudspeakers 112 (e.g., 6.1 surround sound), eight loudspeakers 112 (e.g., 7.1 surround sound), or the like without departing from the disclosure. In some examples, the device 110 may send a first number of reference signals to the AVR 20 and the AVR 20 may generate a second number of reference signals. For example, the device 110 may send two reference signals to the AVR 20 and the AVR 20 may generate additional channels in order to send five reference signals to the loudspeaker(s) 112.

Similarly, while FIG. 1 illustrates the device receiving the input audio data from a single microphone 114, the disclosure is not limited thereto and the device 110 may receive input audio data from any number of microphones 114 without departing from the disclosure. In some examples, the device 110 may receive the input audio data from a microphone array including a plurality of microphones 114.

In audio systems, acoustic echo cancellation (AEC) refers to techniques that are used to recognize when the system 100 has recaptured sound via a microphone after some delay that the system 100 previously output via the loudspeakers 112. The system 100 may perform AEC by subtracting a delayed version of the original audio signal from the captured audio, producing a version of the captured audio that ideally eliminates the "echo" of the original audio signal, leaving only new audio information. For example, if someone were singing karaoke into a microphone while prerecorded music is output by a loudspeaker, AEC can be used to remove any of the recorded music from the audio captured by the microphone, allowing the singer's voice to be amplified and output without also reproducing a delayed "echo" of the original music. As another example, a media player that accepts voice commands via a microphone can use AEC to remove reproduced sounds corresponding to output media that are captured by the microphone, making it easier to process input voice commands.

The system 100 may determine an echo latency estimate (e.g., estimated echo latency). For example, the device 110 may perform latency detection by comparing two sets of signals and detecting how close they are to each other (e.g., determining a time difference between the two sets of signals). In the example illustrated in FIG. 1, the system 100 may estimate the echo latency in an audio system, with the echo (e.g., reference signals output by the loudspeaker(s) 112) being captured along with an utterance (e.g., voice command).

By correctly calculating the echo latency, the system 100 may correct for the echo latency and/or improve speech processing associated with the utterance by performing AEC. For example, the system 100 may use the echo latency to calculate parameters for AEC, such as a step size control parameter/value, a tail length value, a reference delay value, and/or additional information that improves performance of the AEC. The step size control regulates a weighting with which to update adaptive filters that are used to estimate an echo signal (e.g., undesired audio to remove during AEC). For example, a high step size value corresponds to larger changes in the adaptive filter coefficient values (e.g., updating more quickly based on an error signal), which results in the AEC converging faster (e.g., accurately estimating the echo signal such that output audio data only corresponds to the utterance). In contrast, a low step size value corresponds to smaller changes in the adaptive filter coefficient values (e.g., updating more slowly), which results in the AEC converging more slowly but reducing distortion in the output audio data during steady-state conditions (e.g., small variations in the echo signal). Thus, the step size control is used to determine how much to emphasize previous adaptive filter coefficient values relative to current adaptive filter coefficient values. The tail length (e.g., a filter length) configures an amount of history (e.g., an amount of previous values to include when calculating a current value) used to estimate the linear response. For example, a longer tail length corresponds to more previous adaptive filter coefficient values being used to determine a current adaptive filter coefficient value, whereas a lower tail length corresponds to fewer previous adaptive filter coefficient values being used. Finally, the reference delay (e.g., delay estimate) informs the system 100 the exact and/or approximate latency between the playback reference and the microphone capture streams to enable the system 100 to align frames during AEC.

While FIG. 1 illustrates determining an echo latency estimate associated with audio signals being played through loudspeakers, the disclosure is not limited thereto. Instead, the techniques disclosed herein may be applied to other systems to provide latency estimation and/or signal matching in a variety of circumstances. For example, the device 110 may receive input data from multiple sensors and may determine how close the sensors are to each other based on the input data. Thus, the techniques disclosed herein are applicable to systems that use RAdio Detection And Ranging (RADAR) techniques, SOund Navigation And Ranging (SONAR) techniques, and/or other technology without departing from the disclosure. For example, the system may output a known signal of interest to a first device (e.g., loudspeaker, transmitting antenna, sound transmitter, etc.) at a first time and may generate input data using a second device (e.g., microphone, receiving antenna, receiver, etc.). In some examples, the first device and the second device may be the same device. For example, the same antenna may be used for transmitting and receiving using RADAR techniques. Using a cross-correlation between the known signal of interest and the input data, the system may determine when the known signal of interest is detected in the input data (e.g., the signal comes back or returns) at a second time and may determine a precise estimate of the delay between when the signal was sent and when the signal was received (e.g., amount of time elapsed between the first time and the second time). When implemented using RADAR or SONAR techniques, the echo latency estimate may be used to determine a precise location of an object relative to the receiving antenna/receiver. The system may determine a distance to the object (e.g., range), as well as an angle (e.g., bearing), velocity (e.g., speed), altitude, or the like associated with the object.

As illustrated in FIG. 1, the device 110 may send (170) reference signals to loudspeakers 112 and may generate (172) combined reference data based on the reference signals. The reference signals may correspond to individual channels of audio data (e.g., music), such as a first reference signal corresponding to a first channel (e.g., first loudspeaker 112*a*), a second reference signal corresponding to a second channel (e.g., second loudspeaker 112*b*), and so on. In some examples, the reference signals may be unique (e.g., separate audio data sent to each channel), which may enable the device 110 to clearly identify individual reference signals in the input audio data received by the microphone(s) 114. However, the disclosure is not limited thereto and two or more reference signals may be identical without departing from the disclosure. If two or more channels are identical or highly correlated, the device 110 may be unable to identify the individual reference signals in the input audio data. As the device 110 combines the reference signals, the device 110 does not need to identify the individual reference signals in order to determine the echo latency estimate.

The individual reference signals may comprise portions of the audio data being output to the loudspeakers 112 (e.g., music). The device 110 may combine them using a variety of techniques without departing from the disclosure. In some examples, the device 110 may combine the reference signals using a simple average filter (e.g., no history of previous samples or data points), such as calculating a mean using each of the reference signals. In other examples, the device 110 may apply unique filters to each individual reference signal prior to combining the reference signals. For example, the device 110 may apply a first finite impulse response (FIR) filter to the first reference signal, a second FIR filter to the second reference signal, and so on, and then generate the combined reference data using the filtered reference signals. This technique adapts the reference signals based on transmitter characteristics (e.g., characteristics associated with the individual loudspeakers 112) to improve the cross-correlation between the combined reference data and the input data.

The device 110 may receive (174) input data from one or more microphone(s) 114 and may determine (176) cross-correlation data corresponding to a cross-correlation between the combined reference data and the input data. For example, a single microphone 114, a plurality of microphones 114 and/or a microphone array may generate the input data, and the cross-correlation data may indicate a measure of similarity between the input data and the combined reference data as a function of the displacement of one relative to the other. The device 110 may determine the cross-correlation data using any techniques known to one of skill in the art (e.g., normalized cross-covariance function or the like) without departing from the disclosure.

The device 110 may determine (178) a first significant peak represented in the cross-correlation data and may determine (180) an echo latency estimate based on the first significant peak. As will be discussed in greater detail below with regard to FIGS. 4-5, the cross-correlation data may include a first number of unique peaks that corresponds to the number of loudspeakers 112. For example, if the system 100 sends two reference signals to two loudspeakers 112, the cross-correlation data may include two peaks corresponding to locations where each of the two reference signals overlap the input data. Similarly, if the system 100 sends five reference signals to five loudspeakers 112, the cross-correlation data may include five peaks corresponding to locations where each of the five reference signals overlap the input data.

To determine the echo latency estimate, the device 110 may determine the earliest significant peak included in the cross-correlation data. In some examples, the cross-correlation data may include only the first number of unique peaks corresponding to the number of loudspeakers 112, and the device 110 may select the first peak as the earliest significant peak. However, in some examples the cross-correlation data may include additional peaks that do not correspond to the reference signals.

In order to correctly determine the echo latency estimate, the device 110 must determine whether a peak corresponds to the reference signals or corresponds to noise and/or random repetitions in the audio data being output to the loudspeakers 112. For example, the device 110 may determine a maximum value of the cross-correlation data (e.g., magnitude of a highest peak, Peak A indicating a highest correlation between the signals) and determine a threshold value based on the maximum value. The device 110 may then work backwards in time to detect an earlier peak (e.g., Peak B, prior to Peak A), determine a maximum magnitude value associated with the earlier peak and determine whether the maximum magnitude value is above the threshold value. If the maximum magnitude value is below the threshold value, the device 110 may ignore the earlier peak (e.g., Peak B) and may select the highest peak (e.g., Peak A) as the earliest significant peak. If the maximum magnitude value is above the threshold value, the device 110 may select the earlier peak (e.g., Peak B) and repeat the process to determine if there is an even earlier peak (e.g., Peak C) and whether the even earlier peak exceeds the threshold value. If there isn't an earlier peak and/or the earlier peak does not exceed the threshold value (e.g., Peak C is below the threshold value), the device 110 may select Peak B as the earliest significant peak. If there is an earlier peak that exceeds the threshold value, the device 110 may repeat the process in order to detect the earliest significant peak (e.g., first unique peak that exceeds the threshold value).

After selecting the first significant peak, the device 110 may determine the echo latency estimate based on coordinates of the first significant peak. For example, a time index associated with the peak (e.g., coordinate along the x-axis of the cross-correlation data) may be used as the echo latency estimate.

While the examples described above illustrate determining the echo latency estimate based on an earliest significant peak, this corresponds to an instantaneous estimate. In some examples, the device 110 may estimate the latency using a two-stage process. For example, the device 110 may first compute the instantaneous estimate per cross-correlation as a first stage. Then, as a second stage, the device 110 may track the instantaneous estimates over time to provide a final reliable estimate. For example, the second stage may track two estimates, one based on an average of the instantaneous estimates and the other based on tracking any change in the estimate which could result due to framedrop conditions (e.g., audio samples being lost in transit to the loudspeaker(s) 112). The device 110 may switch to the new estimates once the device 110 is confident that the framedrop is for real and not due to peak shift due to the signal.

To illustrate an example, the device 110 may determine a series of instantaneous estimates. If the instantaneous estimates are consistent over a certain duration of time and within a range of tolerance, the device 110 may lock onto the measurement by calculating a final estimate. For example, the device 110 may calculate a final estimate of the echo latency using a moving average of the instantaneous estimates. However, if the instantaneous estimates are varying (e.g., inconsistent and/or outside of the range of tolerance), the device 110 may instead track an alternate measurement of the temporary estimation. Thus, the device 110 wants to ensure that if the instantaneous estimates are off-range of the estimated latency, the device 110 only calculates the final estimate based on the instantaneous estimates once the instantaneous estimates have been consistent for a certain duration of time.

Figure 2:
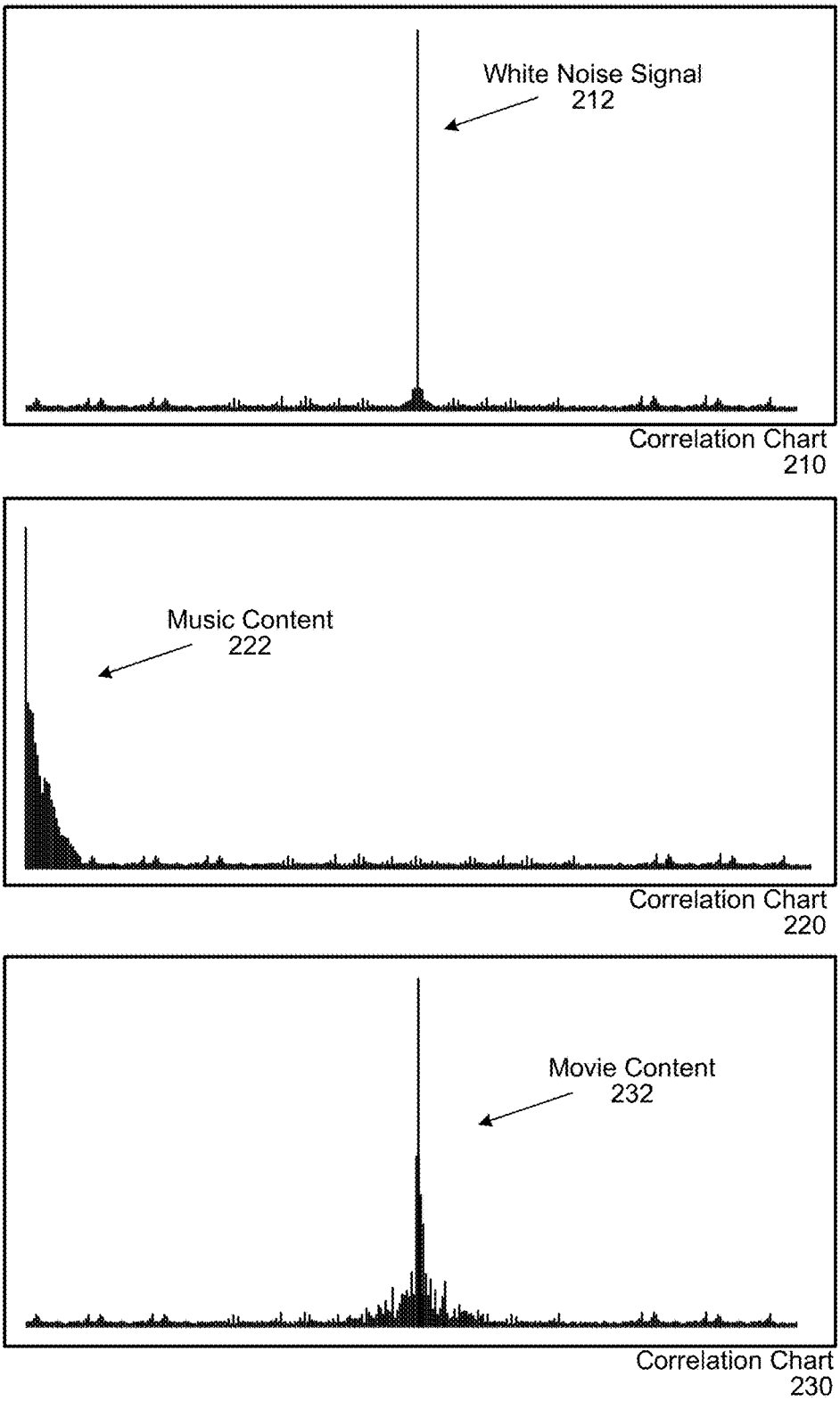
FIG. 2 illustrates examples of cross-correlation charts using different reference signals.

FIG. 2 illustrates examples of cross-correlation charts using different reference signals. As illustrated in FIG. 2, a first correlation chart 210 represents cross-correlation data corresponding to a white noise signal 212 being sent as a reference signal to the loudspeaker 112. As white noise is random, cross-correlation using the white noise signal 212 results in a clearly defined peak in the first correlation chart 210.

A second correlation chart 220 represents cross-correlation data corresponding to music content 222 being sent as a reference signal to the loudspeaker 112. As music may include repetitive noises (e.g., bass track, the beat, etc.), cross-correlation using the music content 222 may result in a poorly defined peak with a gradual slope.

A third correlation chart 230 represents cross-correlation data corresponding to movie content 232 being sent as a reference signal to the loudspeaker 112. Sounds in a movie are typically unique and non-repetitive, so cross-correlation using the movie content 232 results in a more clearly defined peak than the music content 232, while not as clearly defined as the white noise signal 212.

As illustrated in FIG. 2, when the device 110 sends a control signal (e.g., pulse) or a white noise signal 212, the peak may be easily detected in the cross-correlation data and the device 110 may determine the echo latency estimate based on the peak. However, real-world situations involving music content 222 and movie content 232 are less clearly defined and therefore less easily detected in the cross-correlation data. In addition, different transmitters (e.g., loudspeakers) will have different latencies, depending on where they are located and how loud they are playing, a frequency response of the transmitter and/or other characteristics of the transmitter, so the device 110 has to accommodate all of these different scenarios and accurately detect the reference signal in the cross-correlation data.

Figure 3:
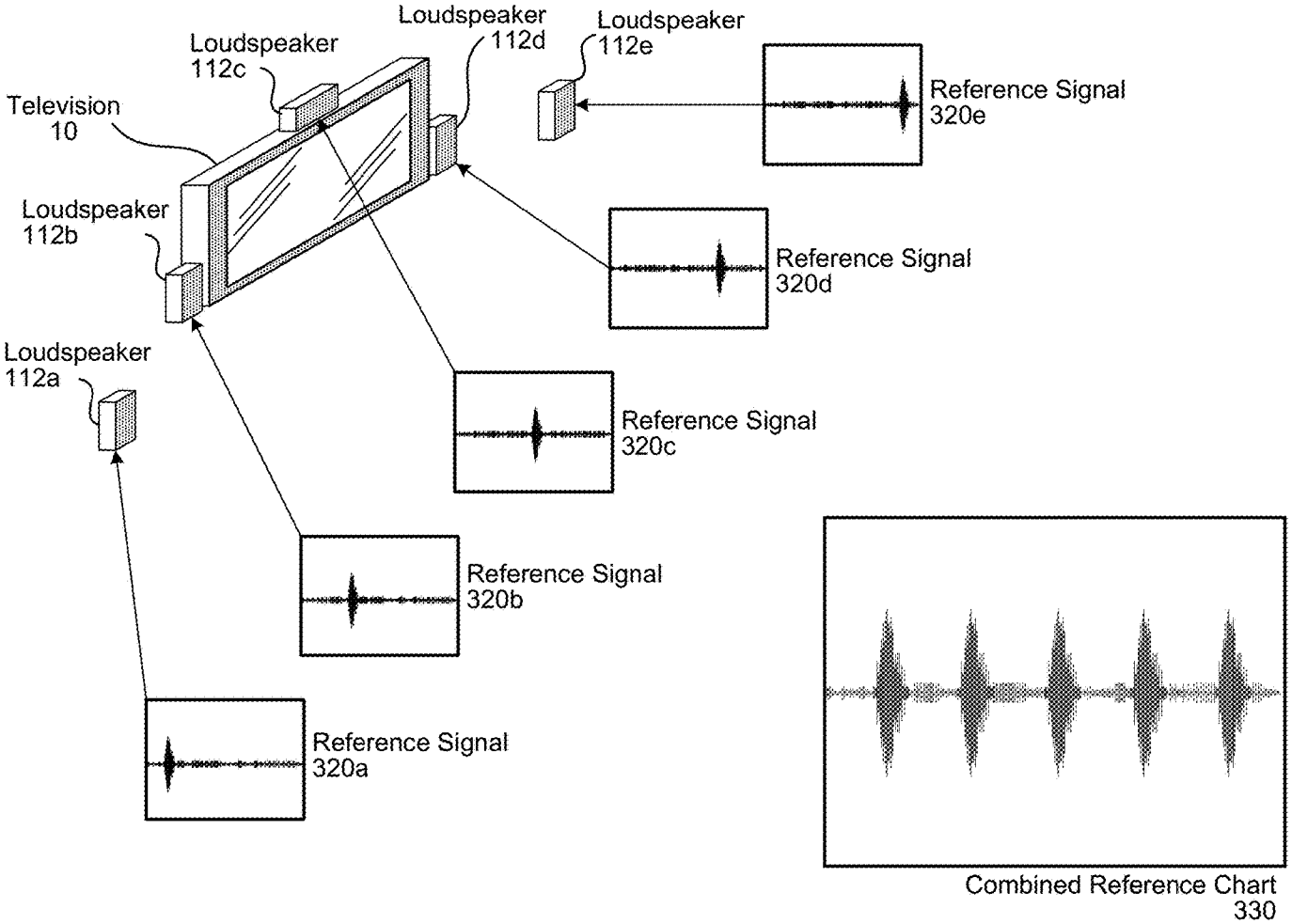
FIG. 3 illustrates an example of combining reference signals prior to determining a cross-correlation according to embodiments of the present disclosure.

FIG. 3 illustrates an example of combining reference signals prior to determining a cross-correlation according to embodiments of the present disclosure. As illustrated in FIG. 3, the device 110 may send unique reference signals 320 to each of the loudspeakers 112. For example, the device 110 may send a first reference signal 320*a* to a first loudspeaker 112*a*, a second reference signal 320*b* to a second loudspeaker 112*b*, a third reference signal 320*c* to a third loudspeaker 112*c*, a fourth reference signal 320*d* to a fourth loudspeaker 112*d* and a fifth reference signal 320*e* to a fifth loudspeaker 112*e*.

For ease of illustration, FIG. 3 illustrates the reference signals as a pulse signal (e.g., short burst of audio data), with the pulse signal being sent to each loudspeaker 112 at a different point in time. For example, the first reference signal 320*a* includes the pulse signal at a first time, the second reference signal 320*b* includes the pulse signal at a second time, and so on. While FIG. 3 illustrates the reference signals 320 as pulse signals, this is intended for ease of illustration and the disclosure is not limited thereto. Instead, each of the reference signals 320 may correspond to audio data being sent to an individual loudspeaker 312. Thus, each reference signal 320 could be unique (e.g., the first reference signal 320*a* corresponds to a first portion of audio data that is different than a second portion of the audio data included in reference signal 320*b*), although the disclosure is not limited thereto and some or all of the reference signals 320 could be identical without departing from the disclosure. Additionally or alternatively, the reference signals 320 can overlap without departing from the disclosure. For example, while the combined reference chart 330 illustrates the pulse signal being sent to each loudspeaker 112 sequentially, the pulse signal may be sent to multiple loudspeakers 112 at the same time without departing from the disclosure.

One way of determining the echo latency estimate is to treat each reference signal individually. For example, some techniques known in the art determines a cross-correlation between different channels and tries to identify a unique peak for each channel. However, the accuracy of this technique depends on the content of the reference signals, as different channels could have a low correlation or a high correlation. If the channels have a low correlation, a unique peak may be determined for each individual channel. However, if the channels have a high correlation, it is difficult to identify a unique peak for each channel.

To improve an accuracy associated with determining an echo latency estimate, the system 100 of the present disclosure combines multiple reference signals into combined reference data, as illustrated by combined reference chart 330. Thus, regardless of whether the individual channels are highly correlated or not, the system 100 may identify a number of unique peaks in the cross-correlation data and may determine an earliest significant peak (e.g., peak preceding other peaks and having a magnitude exceeding a threshold) with which to estimate the echo latency. As illustrated in FIG. 3, the combined reference chart 330 illustrates that the combined reference data includes each of the individual reference signals 320, with five unique peaks corresponding to the five pulse signals.

While FIG. 3 illustrates the combined reference chart 330 as including the five pulse signals sent to the individual loudspeakers 112, this depiction is intended for ease of illustration and may not be to scale. For example, in some examples the device 110 may determine the combined reference data by taking an average of the reference signals 320, in which case the maximum magnitude of each of the pulse signals represented in the combined reference chart 330 would be one fifth (20%) of the maximum magnitude represented by the individual reference signals 320.

Additionally or alternatively, the device 110 may determine the combined reference data by first filtering the reference signals to account for transmitter characteristics (e.g., a frequency response, impulse response, etc.) associated with the individual loudspeakers 112. For example, the device 110 may filter the first reference signal 320*a* using a first filter (e.g., finite impulse response (FIR) filter) to account for a first frequency response (e.g., transmitter characteristics) associated with the first loudspeaker 112*a*, the device 110 may filter the second reference signal 320*b* using a second filter to account for a second frequency response associated with the second loudspeaker 112*b*, and so on. Thus, the device 110 may adapt the reference signals 320 based on the transmitter characteristics associated with the loudspeakers 112 prior to generating the combined reference data. This technique improves the cross-correlation data by more clearly defining the peaks associated with the loudspeakers 112.

To illustrate an example, the device 110 may compensate for loudspeaker-specific transmitters characteristics such as a frequency range of the loudspeaker 112. For example, if the first reference signal 320*a* has multiple tones but the first loudspeaker 112*a* can only output a single tone (e.g., 1000 Hz), the device 110 may filter the first reference signal 320*a* to remove the additional tones, leaving only the tone (e.g., 1000 Hz) that the first loudspeaker 112*a* can output. Additionally or alternatively, the device 110 may filter the first reference signal 320*a* using an impulse response associated with the first loudspeaker 112*a*, which takes into account an environment around the first loudspeaker 112*a*. By filtering the reference signal 320*a*, the device 110 may improve the cross-correlation data and therefore an accuracy of the echo latency estimate.

Figure 4:
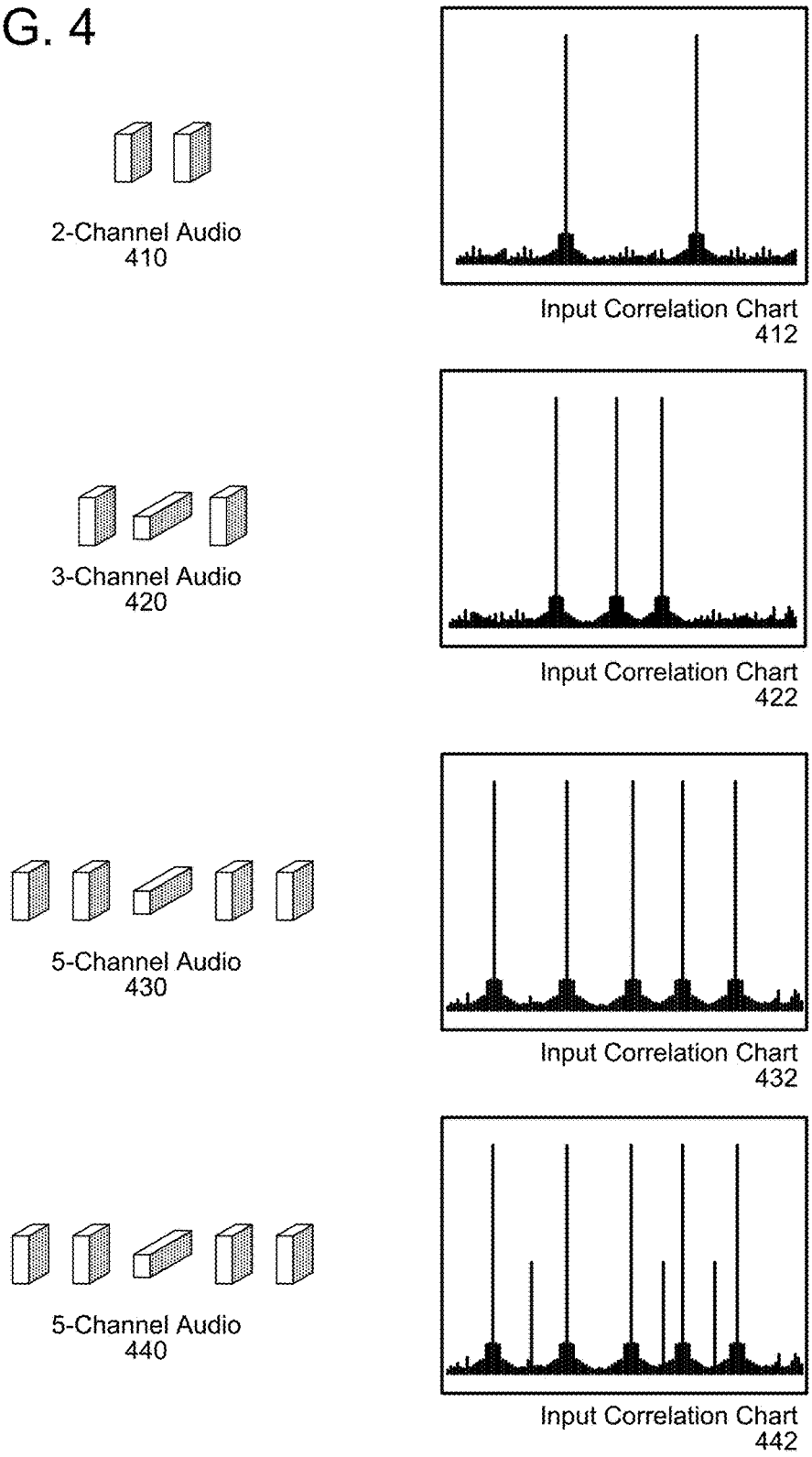
FIG. 4 illustrates examples of possible input correlation charts depending on a number of reference signals according to embodiments of the present disclosure.

As discussed above, the number of unique peaks in the cross-correlation data corresponds to the number of channels (e.g., loudspeakers 112). FIG. 4 illustrates examples of possible input correlation charts depending on a number of reference signals according to embodiments of the present disclosure. As illustrated in FIG. 4, 2-channel audio 410 (e.g., stereo audio) corresponds to cross-correlation data including two peaks, as illustrated by first input correlation chart 412. Similarly, 3-channel audio 420 (e.g., left-center-right) corresponds to cross-correlation data including three peaks, as illustrated by second input correlation chart 422. Finally, 5-channel audio 430 corresponds to cross-correlation data including five peaks, as illustrated by third input correlation chart 432.

In some examples, the device 110 may detect more unique peaks than the number of channels, as illustrated by fourth input correlation chart 442. For example, 5-channel audio 440 corresponds to cross-correlation data including eight peaks, with five "significant peaks" and three minor peaks. The device 110 may determine the five highest peaks and may associate the five highest peaks with the 5-channel audio 440, as described in greater detail below.

The examples illustrated in FIG. 4 are provided for illustrative purposes only and the disclosure is not limited thereto. Instead, the number of channels may vary without departing from the disclosure. In addition, while several of the input correlation charts illustrated in FIG. 4 include a number of unique peaks equal to the number of channels, the disclosure is not limited thereto. In some examples, there may be fewer unique peaks than the number of channels, such as when peaks corresponding to two or more loudspeakers 112 overlap. When there are fewer unique peaks than the number of channels, the echo latency estimate may still be accurate as the device 110 may select the earliest significant peak, even if it includes two merged peaks. In other examples, there may be more unique peaks than the number of channels, such as when the audio data being sent to the loudspeakers 112 includes repetitive sounds or the like. In this example, the echo latency estimate may not be accurate, as the device 110 may be unable to determine whether the peaks correspond to the reference signal repeating or to separate reference signals. In some examples, the device 110 may be configured to detect repetition in the reference signal(s) and determine whether the reference signal is valid for determining the cross-correlation, as will be described in greater detail below with regard to FIG. 6.

Figure 5:
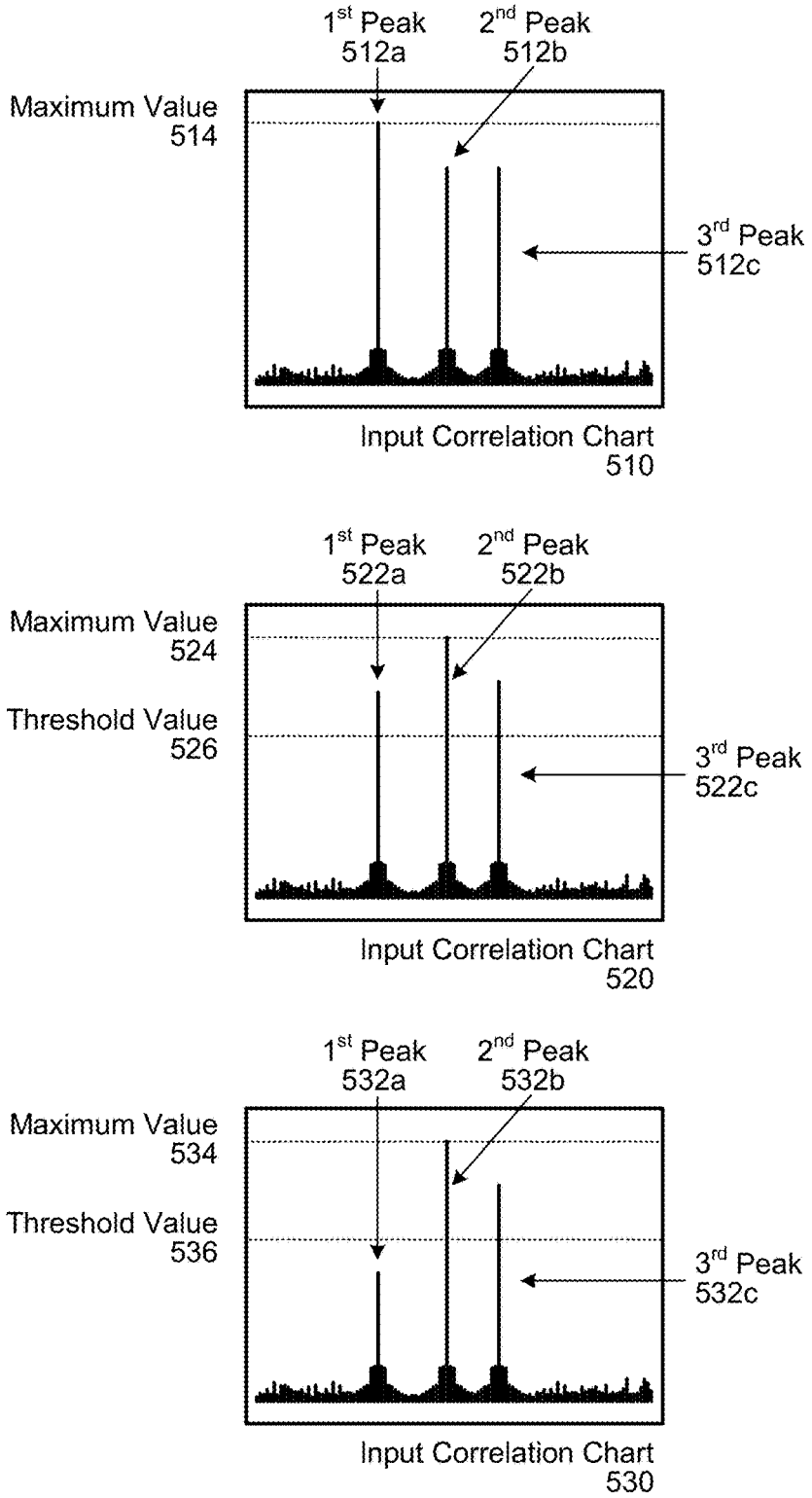
FIG. 5 illustrates examples of selecting a significant peak for latency estimation according to embodiments of the present disclosure.

FIG. 5 illustrates examples of selecting a significant peak for latency estimation according to embodiments of the present disclosure. As discussed above, the device 110 may determine a first number of unique peaks in the cross-correlation data based on the number of channels (e.g., loudspeakers 112). To estimate the echo latency, the device 110 may determine an earliest significant peak (e.g., peak preceding other peaks and having a magnitude exceeding a threshold).

To determine the earliest significant peak, the device 110 may determine a highest peak (e.g., peak with a highest magnitude) in the cross-correlation data. The device 110 may then determine if there are any unique peaks preceding the highest peak. If there are previous unique peaks, the device 110 may determine a threshold value based on the highest magnitude and may determine if the previous unique peak is above the threshold value. In some examples, the threshold value may be based on a percentage of the highest magnitude, a ratio, or the like. For example, the threshold value may correspond to a ratio of a first magnitude of the previous peak to the highest magnitude of the highest peak. Thus, if the previous peak is above the threshold value, a first ratio of the first magnitude to the highest magnitude is above the desired ratio. However, if the previous peak is below the threshold value, a second ratio of the first magnitude to the highest magnitude is below the desired ratio.

FIG. 5 illustrates a first input correlation chart 510 that illustrates first cross-correlation data. As illustrated in the first input correlation chart 510, the device 110 may identify a first peak 512*a*, a second peak 512*b*, and a third peak 512*c*. The device 110 may determine a maximum value 514 in the first cross-correlation data and determine that the maximum value 514 (e.g., highest magnitude) corresponds to the first peak 512*a*. Thus, the first peak 512*a* is the highest peak. In this example, the device 110 may not detect any previous peaks prior to the first peak 512*a* and may select the first peak 512*a* as the earliest significant peak with which to determine the echo latency estimate.

Second input correlation chart 520 illustrates second cross-correlation data that corresponds to an example where there is a previous peak prior to the highest peak. As illustrated in the second input correlation chart 520, the device 110 may identify a first peak 522*a*, a second peak 522*b*, and a third peak 522*c*. The device 110 may determine a maximum value 524 in the second cross-correlation data and determine that the maximum value 524 (e.g., highest magnitude) corresponds to the second peak 522*b*. Thus, the second peak 522*b* is the highest peak, but the device 110 may determine that the first peak 522*a* is earlier than the second peak 522*b*.

To determine whether the first peak 522*a* is significant and should be used to estimate the echo latency, the device 110 may determine a threshold value 526 based on the maximum value 524. The device 110 may then determine a magnitude associated with the first peak 522*a* and whether the magnitude exceeds the threshold value 526. As illustrated in the second input correlation chart 520, the magnitude of the first peak 522*a* does exceed the threshold value 526 and the device 110 may select the first peak 522*a* as the earliest significant peak and may use the first peak 522*a* to determine the echo latency estimate.

The example illustrated in the second input correlation chart 520 may correspond to a weak transmitter (e.g., first loudspeaker 112*a* at a relatively lower volume and/or directed away from the microphone 114) being placed closer to the microphone 114, whereas another transmitter that is further away is generating strong signals (e.g., second loudspeaker 112*b* at a relatively higher volume and/or directed towards the microphone 114). The device 110 may detect that the second loudspeaker 112*b* corresponds to the highest peak in the second cross-correlation data (e.g., second peak 522*b*), but may use the first peak 522*a* to estimate the echo latency even though the first peak 522*a* is weaker than the second peak 522*b*.

Third input correlation chart 530 illustrates third cross-correlation data that corresponds to another example where there is a previous peak prior to the highest peak. As illustrated in the third input correlation chart 530, the device 110 may identify a first peak 532*a*, a second peak 532*b*, and a third peak 532*c*. The device 110 may determine a maximum value 534 in the third cross-correlation data and determine that the maximum value 534 (e.g., highest magnitude) corresponds to the second peak 532*b*. Thus, the second peak 532*b* is the highest peak, but the device 110 may determine that the first peak 532*a* is earlier than the second peak 532*b*.

To determine whether the first peak 532*a* is significant and should be used to estimate the echo latency, the device 110 may determine a threshold value 536 based on the maximum value 534. The device 110 may then determine a magnitude associated with the first peak 532*a* and whether the magnitude exceeds the threshold value 536. As illustrated in the third input correlation chart 530, the magnitude of the first peak 532*a* does not exceed the threshold value 536 and the device 110 may not select (e.g., may ignore) the first peak 532*a* as the earliest significant peak. Instead, the device 110 may select the second peak 532*b* as the earliest significant peak and may use the second peak 532*b* to determine the echo latency estimate.

While the first peak 532*a* may correspond to audio received from a first loudspeaker 112*a*, because the first peak 532*a* is below the threshold value 536 the device 110 may not consider it strong enough to use to estimate the echo latency. For example, the device 110 may be unable to determine if the first peak 532*a* corresponds to receiving audio from the loudspeakers 112 or instead corresponds to noise, repetition in the reference signal or other factors that are not associated with receiving audio from the loudspeakers 112.

The examples illustrated in FIG. 5 are provided for illustrative purposes only and the disclosure is not limited thereto. In some examples, there may be more than one peak earlier than the highest peak. For example, a fourth peak 522*d* may be earlier than the first peak 522*a* in the second input correlation chart 520 and a fourth peak 532*d* may be earlier than the first peak 532*a* in the third input correlation chart 530. The device 110 may repeat the process for each of the earlier peaks to determine the earliest significant peak.

As a first example, the device 110 may determine that the first peak 522*a* is above the threshold value 526 and may select the first peak 522*a*. However, the device 110 may determine that the fourth peak 522*d* is earlier than the first peak 522*a* and may determine if the fourth peak 522*d* is above the threshold value 526. If the fourth peak 522*d* is also above the threshold value 526, the device 110 may select the fourth peak 522*d* as the earliest significant peak. If the fourth peak 522*d* is below the threshold value 526, the device 110 may select the first peak 522*a* as the earliest significant peak.

As a second example, the device 110 may determine that the first peak 532*a* is below the threshold value 536 and may not select the first peak 532*a*. However, the device 110 may determine that the fourth peak 532*d* is earlier than the first peak 532*a* and may determine if the fourth peak 532*d* is above the threshold value 536. If the fourth peak 532*d* is above the threshold value 536, the device 110 may select the fourth peak 532*d* as the earliest significant peak. If the fourth peak 532*d* is below the threshold value 536, the device 110 may select the second peak 532*b* as the earliest significant peak.

In some examples, the device 110 may determine if the cross-correlation data includes a strong peak with which to estimate the echo latency. In some examples, a highest peak of the cross-correlation data may may not be strong enough to provide an accurate estimate of the echo latency. To determine whether the highest peak is strong enough, the device 110 may take absolute values of the cross-correlation data and sort the peaks in declining order. For example, the device 110 may sort peaks included in the cross-correlation data declining order of magnitude and determine percentiles (e.g., $10^{th}$ percentile, $50^{th}$ percentile, etc.) associated with individual peaks. The device 110 may determine a ratio of a first value (e.g., highest magnitude associated with the first peak) of the cross-correlation data to a specific percentile (e.g., $10^{th}$ percentile, $50^{th}$ percentile, etc.). If the ratio is lower than a threshold value, this indicates that the first peak is only slightly larger than the specific percentile, indicating that the first peak is not strong enough (e.g., clearly defined and/or having a higher magnitude than other peaks) and the cross-correlation data is inadequate to provide an accurate estimate of the echo latency. If the ratio is higher than the threshold value, this indicates that the first peak is sufficiently larger than the specific percentile, indicating that the first peak is strong enough to provide an accurate estimate of the echo latency.

As discussed above, repetition in the reference signal(s) may result in additional unique peaks in the cross-correlation data. Thus, a first number of unique peaks in the cross-correlation data may be greater than the number of channels. Repetition in the reference signal(s) may correspond to repetitive sounds, beats, words or the like, such as a bass portion of a techno song. When the reference signal(s) include repetitive sounds, the device 110 may be unable to accurately determine the echo latency estimate as the device 110 may be unable to determine whether the peaks correspond to the reference signal repeating or to separate reference signals. In some examples, the device 110 may be configured to detect repetition in the reference signal(s) and determine whether the reference signal is valid for determining the cross-correlation.

Figure 6:
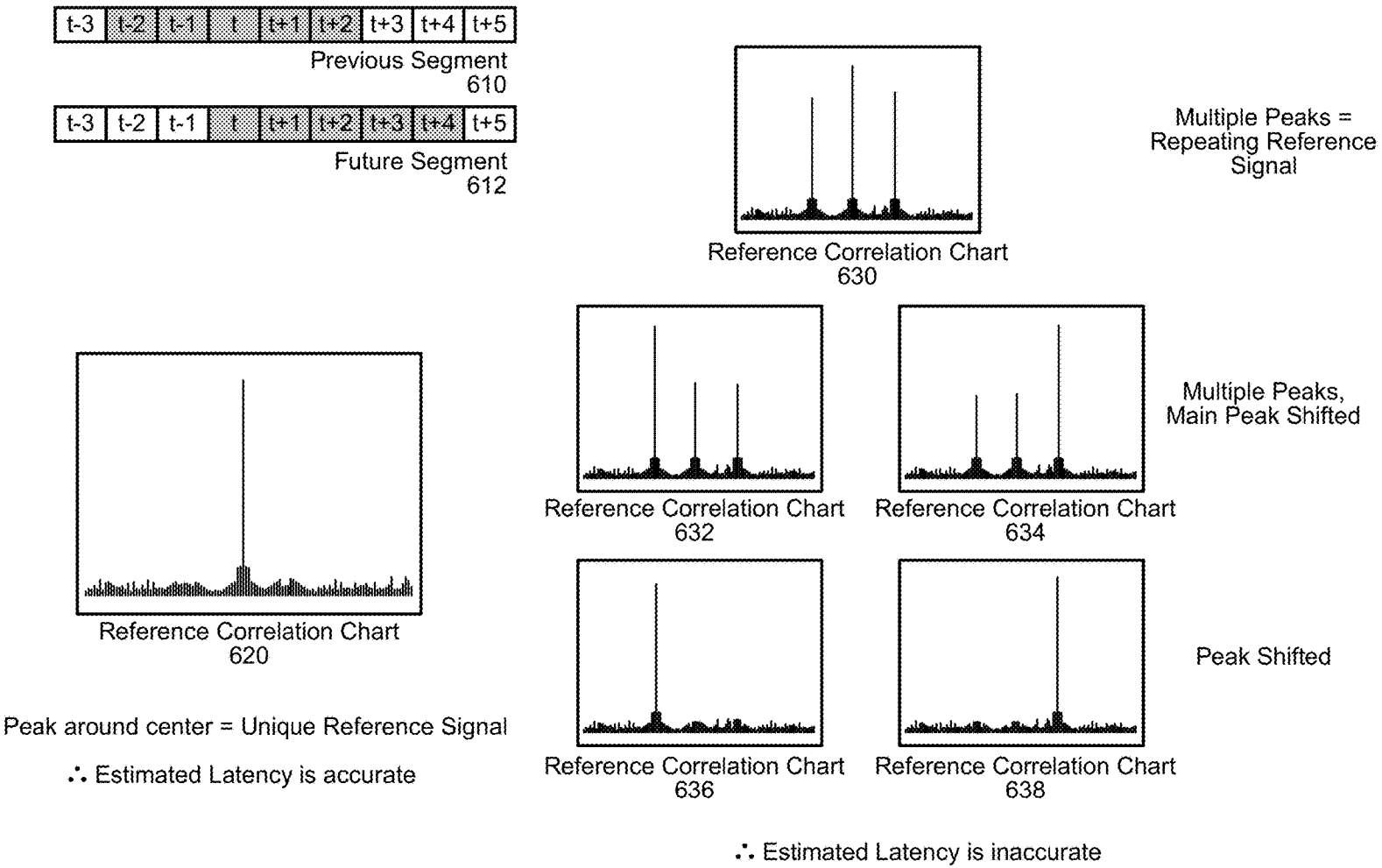
FIG. 6 illustrates an example of performing reference signal validation according to embodiments of the present disclosure.

FIG. 6 illustrates an example of performing reference signal validation according to embodiments of the present disclosure. As illustrated in FIG. 6, the device 110 may determine cross-correlation data between a previous segment 610 and a future segment 612 in the reference signal. In the example illustrated in FIG. 6, the device 110 may use a first time period corresponding to a max delay (e.g., 2) to determine the previous segment 610 and the future segment 612. For example, the previous segment 610 corresponds to the first time period before a current time and the first time period after the current time (e.g., audio sample t−2 to audio sample t+2). Similarly, the future segment 612 corresponds to twice the first time period after the current time (e.g., audio sample t to audio sample t+4). Thus, the previous segment 610 and the future segment 612 have an equal length (e.g., 5 audio samples) and overlap each other in an overlap region (e.g., audio sample t to audio sample t+2 are included in both the previous segment 610 and the future segment 612).

If the reference signal does not include repetitive sounds, the cross-correlation data between the previous segment 610 and the future segment 612 should have a single, clearly defined peak corresponding to the overlap region. If the reference signal does include repetitive sounds, however, the cross-correlation data may have multiple peaks and/or a highest peak may be offset relative to the overlap region. For example, the highest peak being offset may indicate that previous audio segments are strongly correlated to future audio segments, instead of and/or in addition to a correlation within the overlap region. If the reference signal includes repetitive sounds, the reference signal may not be useful for determining the echo latency estimate.

FIG. 6 illustrates a first reference correlation chart 620 that represents first cross-correlation data between the previous segment 610 and the future segment 612 having a single peak in the overlap region. As there is a single peak corresponding to the overlap region, the first reference correlation chart 620 corresponds to a unique reference signal and the device 110 may use the reference signal to estimate the echo latency.

In contrast, a second reference correlation chart 630 represents second cross-correlation data between the previous segment 610 and the future segment 612 having multiple peaks that are not limited to the overlap region. As there are multiple peaks, the second reference correlation chart 630 corresponds to a repeating reference signal and the device 110 may not use the reference signal to estimate the echo latency. Thus, the device 110 may not determine the echo latency estimate for a period of time corresponding to the repeating reference signal and/or may discard echo latency estimates corresponding to the repeating reference signal.

While the second reference correlation chart 630 illustrates three peaks centered on a highest peak, in some examples the highest peak may be offset to the left or the right. A third reference correlation chart 632 illustrates the highest peak offset to the left, which corresponds to an earlier portion (e.g., audio sample t−2 to audio sample t) in the previous segment 610 having a strong correlation to a later portion (e.g., audio sample t to audio sample t+2) in the future segment 612. Alternatively, a fourth reference correlation chart 634 illustrates the highest peak offset to the right, which corresponds to the later portion in the previous segment 610 having a strong correlation to the earlier portion in the future segment 612.

In some examples, the reference cross-correlation data may include only a single peak that is offset. A fifth reference correlation chart 636 illustrates an example of a single peak offset to the left, while a sixth reference correlation chart 638 illustrates an example of a single peak offset to the right.

Figure 7:
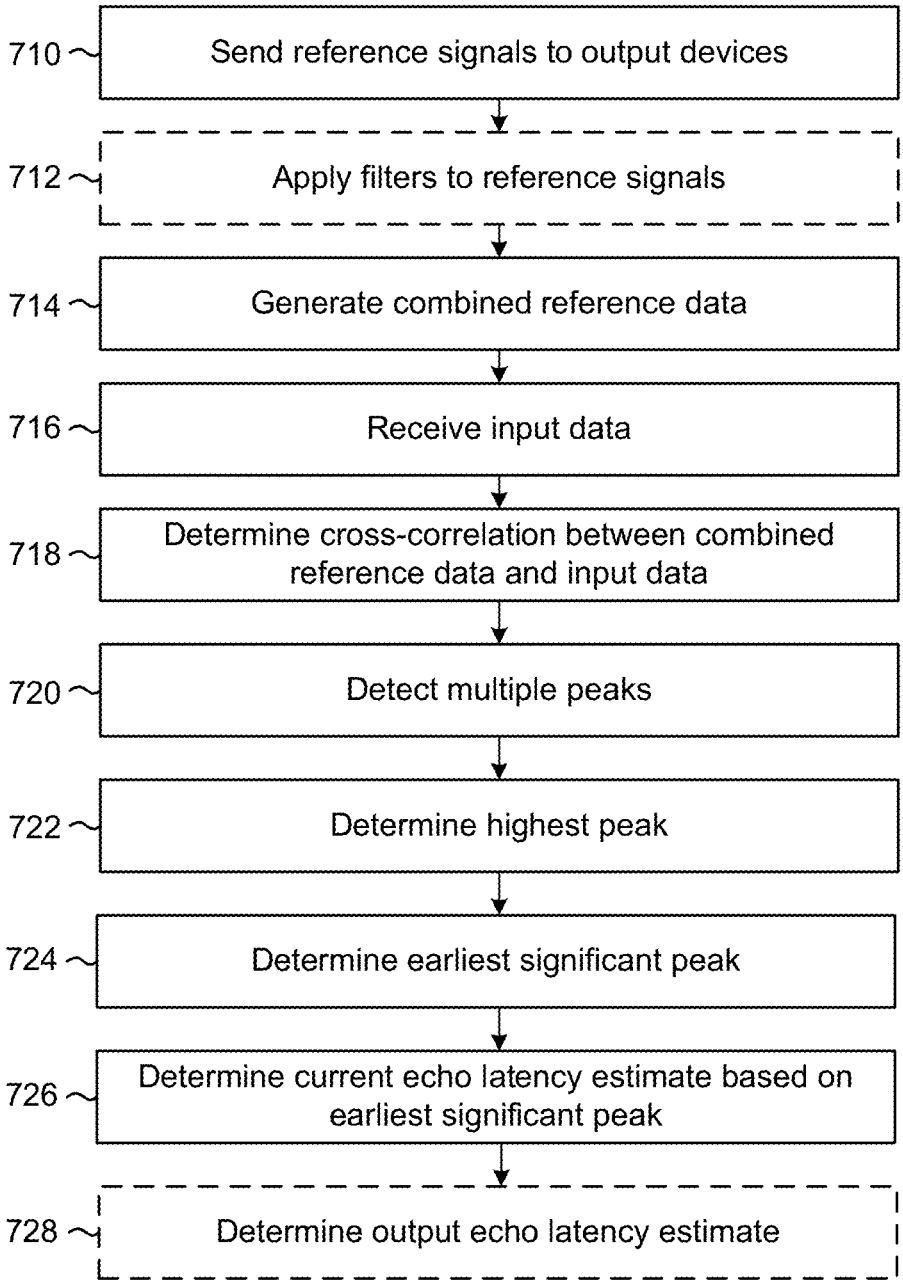
FIG. 7 is a flowchart conceptually illustrating an example method for determining an echo latency estimate according to embodiments of the present disclosure.

FIG. 7 is a flowchart conceptually illustrating an example method for determining an echo latency estimate according to embodiments of the present disclosure. As illustrated in FIG. 7, the device 110 may send (710) reference signals to output devices (e.g., loudspeakers 112, transmitters, etc.) to generate an output (e.g., audio). As illustrated in FIG. 1, in some examples the device 110 may send the reference signals to the output devices via an intermediary device (e.g., audio video receiver (AVR), television, etc.) without departing from the disclosure. The intermediary device may apply additional processing, which may be nonlinear. For example, the intermediary device may apply additional processing to generate modified reference signals and may send the modified reference signals to the output devices. The device 110 may optionally apply (712) filters to the reference signals to adapt the reference signals based on transmitter characteristics associated with the output devices and/or the intermediary device. The device 110 may generate (714) combined reference data, such as by using an averaging filter (e.g., determining a statistical mean) on the reference signals or the filtered reference signals.

The device 110 may receive (716) input data, such as input audio data generated by microphone(s). The device 110 may determine (718) cross-correlation data corresponding to a cross-correlation between the combined reference data and the input data. The device 110 may detect (720) multiple peaks in the cross-correlation data, may determine (722) a highest peak of the multiple peaks, and may determine (724) an earliest significant peak in the cross-correlation data. For example, the device 110 may use the highest peak to determine a threshold value and may compare peaks earlier than the highest peak to the threshold value to determine if they are significant, as described in greater detail below with regard to FIG. 8. The device 110 may then determine (726) a current echo latency estimate based on the earliest significant peak. For example, the device 110 may determine the current echo latency estimate based on coordinates of the earliest significant peak along an x-axis.

The current echo latency estimate determined in step 726 may be referred to as an instantaneous estimate and the device 110 may determine instantaneous estimates periodically over time. In some examples, the device 110 may use the current echo latency estimate without performing any additional calculations. However, variations in the instantaneous estimates may reduce an accuracy and/or consistency of the echo latency estimate used by the device 110, resulting in degraded performance and/or distortion. To improve an accuracy of the echo latency estimate, in some examples the device 110 may generate a more stable echo latency estimate using a plurality of instantaneous estimates in a two-stage process. For example, the device 110 may first compute the instantaneous estimates per cross-correlation as a first stage. Then, as a second stage, the device 110 may track the instantaneous estimates over time to provide a final reliable estimate.

As illustrated by dashed lines in FIG. 7, the device 110 may optionally determine (728) an output echo latency estimate using the current echo latency estimate along with previous echo latency estimates. For example, the device 110 may combine the instantaneous estimates, including the current echo latency estimate, using a moving average, a weighted average or any techniques known to one of skill in the art without departing from the disclosure. This may improve the accuracy of the echo latency estimate and/or improve performance of the device 110 by smoothing out variations in the instantaneous estimates.

By accurately determining the echo latency estimate, the system 100 may correct for echo latency and/or improve speech processing associated with an utterance by performing acoustic echo cancellation (AEC). For example, the system 100 may use the echo latency estimate to calculate parameters for AEC, such as a step size control parameter/value, a tail length value, a reference delay value, and/or additional information that improves performance of the AEC. Additionally or alternatively, the system 100 may perform the steps described above using non-audio signals to determine an echo latency estimate associated with other transmission techniques, such as RADAR, SONAR, or the like without departing from the disclosure.

Figure 8:
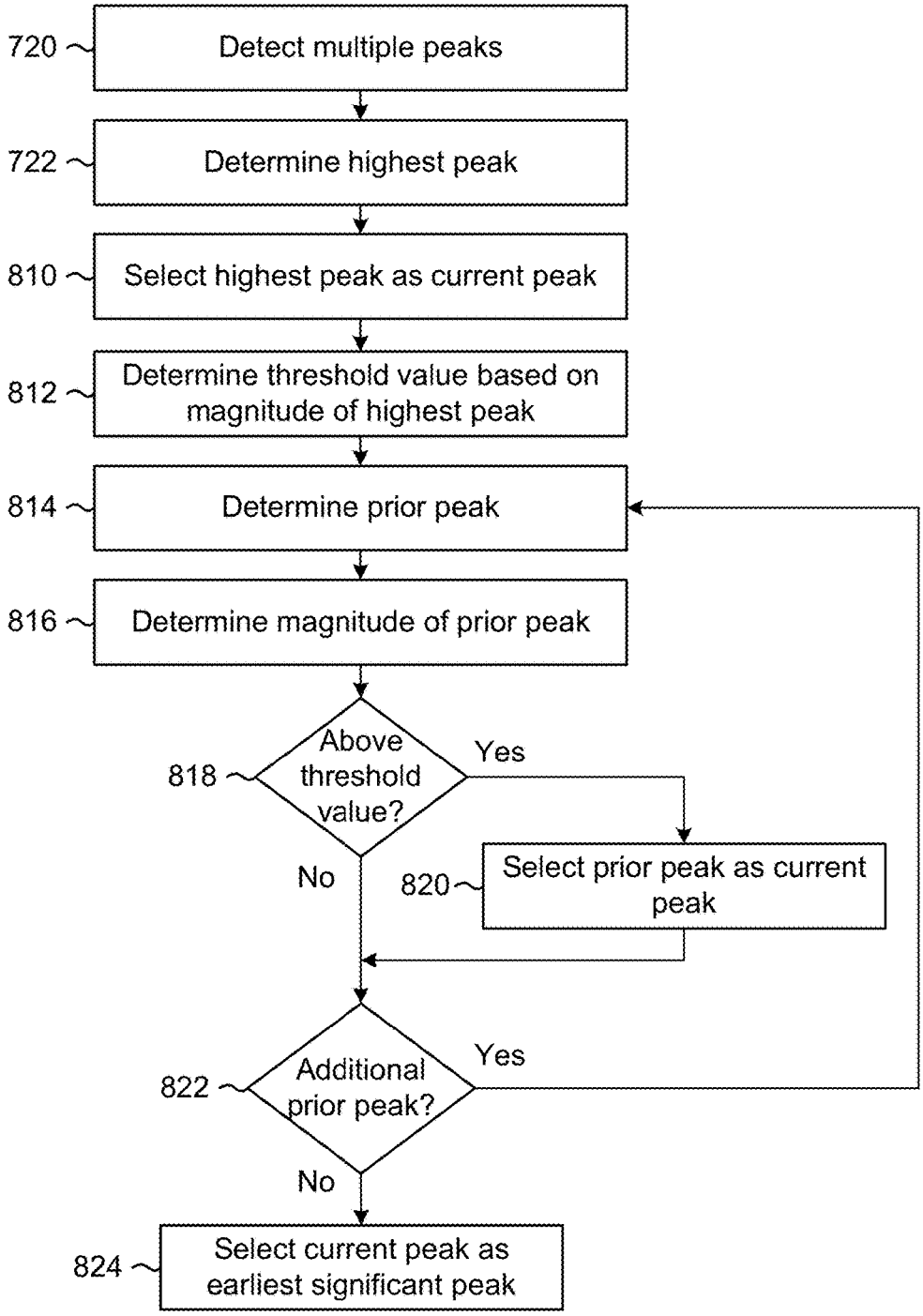
FIG. 8 is a flowchart conceptually illustrating an example method for determining a significant peak according to embodiments of the present disclosure.

FIG. 8 is a flowchart conceptually illustrating an example method for determining an earliest significant peak according to embodiments of the present disclosure. As illustrated in FIG. 8, the device 110 may detect (720) the multiple peaks and determine (722) the highest peak, as discussed above with regard to FIG. 7. The device 110 may select (810) the highest peak as a current peak and determine (812) a threshold value based on a magnitude of the highest peak.

The device 110 may determine (812) that there is a prior peak. If the device 110 doesn't determine that there is a prior peak, the device 110 would select the highest peak as the earliest significant peak. If the device 110 determines that there is a prior peak, the device 110 may determine (816) a magnitude of the prior peak and determine (818) if the magnitude is above the threshold value. If the magnitude is not above the threshold value, the device 110 may skip to step 822. If the magnitude is above the threshold value, the device 110 may select (820) the prior peak as the current peak and proceed to step 822. The device 110 may determine (822) if there is an additional prior peak, and if so, may loop to step 814 and repeat steps 814-822. If the device 110 determines that there is not an additional prior peak, the device 110 may select (824) the current peak as the earliest significant peak.

For example, if the highest peak is the earliest peak (e.g., no prior peaks before the highest peak), the device 110 may select the highest peak as the earliest significant peak. If there are prior peaks that are below the threshold value, the device 110 may select the highest peak as the earliest significant peak. However, if there are prior peaks above the threshold value, the device 110 may select the prior peak as the current peak and repeat the process until the current peak is the earliest peak above the threshold value.

When the reference signals are transmitted to the loudspeakers 112 and the input data is generated by the microphone(s) 114, the input data may include noise. In some examples, the device 110 may improve the cross-correlation data between the input data and the combined reference data by applying a transformation in the frequency domain that takes into account the noise. For example, the device 110 may apply a gain to each frequency bin based on the inverse of its magnitude. Thus, the device 110 may apply the following transformation:

$$\text{Correlation}_{modified}=ifft((fft(Ref)*\text{conj}(fft(mic))/\|fft(mic)\|) \quad (1)$$

where $\text{Correlation}_{modified}$ is the modified cross-correlation data, fft(Ref) is a fast Fourier transform (FFT) of the combined reference data, fft(mic) is a FFT of the input data (e.g., data generated by the microphone(s) 114), conj(fft(mic)) is a conjugate of the FFT of the input data, ||fft(mic)|| is an absolute value of the FFT of the input data, and ifft is an inverse fast Fourier transform.

The input data and the combined reference data may be zero padded to avoid overlap in the FFT domain. This transformation may compensate for those frequency bands that are affected by external noise/interference, which minimizes any influence that the noise may have on the peak in the cross-correlation data. Thus, if there is noise in a particular frequency bin, equation (1) minimizes the effect of the noise. For example, if someone is speaking while classical music is being output by the loudspeakers 112, the frequency bands associated with the speech and the classical music are distinct. Thus, the device 110 may ensure that the frequency bands associated with the speech are not being added to the cross-correlation data.

While the output echo latency estimate calculated in step 728 may account for small changes and/or variations in the instantaneous estimates over time, the instantaneous estimates may vary drastically at a specific point in time. To improve an accuracy of the output echo latency estimate when the instantaneous estimates change suddenly, the second stage may track two estimates. For example, the device 110 may generate first estimates based on an average of the instantaneous estimates and second estimates based on tracking any change in the estimate which could result due to framedrop conditions. The device 110 may determine that the first estimates are accurate (e.g., only a temporary deviation from the expected echo latency estimates) or may switch to the second estimates once the device 110 is confident that the second estimates are accurate (e.g., the change is due to a permanent peak shift in the signal).

To illustrate an example, the device 110 may determine a series of instantaneous estimates. If the instantaneous estimates are consistent over a certain duration of time and within a range of tolerance, the device 110 may lock onto the measurement by calculating a final estimate. For example, the device 110 may calculate a final estimate of the echo latency using a moving average of the instantaneous estimates. However, if the instantaneous estimates are varying (e.g., inconsistent and/or outside of the range of tolerance), the device 110 may instead track an alternate measurement of the temporary estimation. Thus, the device 110 wants to ensure that if the instantaneous estimates are off-range of the estimated latency, the device 110 only calculates the final estimate based on the instantaneous estimates once the instantaneous estimates have been consistent for a duration of time.

Figure 9:
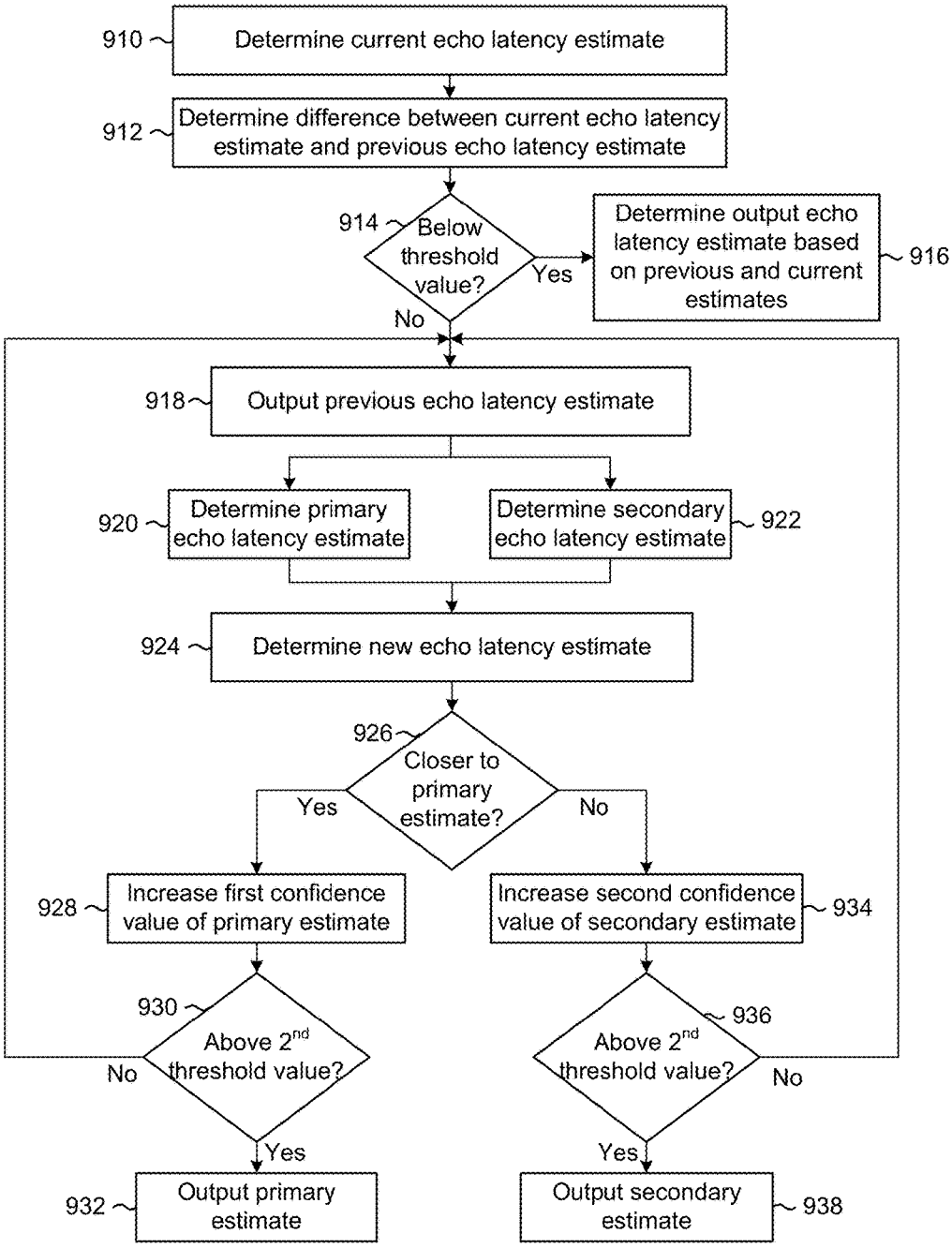
FIG. 9 is a flowchart conceptually illustrating an example method for generating multiple latency estimates according to embodiments of the present disclosure.

FIG. 9 is a flowchart conceptually illustrating an example method for generating multiple latency estimates according to embodiments of the present disclosure. As illustrated in FIG. 9, the device 110 may determine (910) a current echo latency estimate and may determine (912) a difference between the current echo latency estimate and a previous echo latency estimate. For example, the device 110 may compare the current echo latency estimate to previous echo latency estimate(s) to identify if the current echo latency estimate is relatively close to the previous echo latency estimate(s).

The device 110 may determine (914) if the difference is below a threshold value and, if so, may determine (916) an output echo latency estimate based on the previous echo latency estimate(s) and the current echo latency estimate. For example, the device 110 may take a moving average, a weighted average, or the like using any technique known to one of skill in the art.

If the device 110 determines that the difference is above the threshold value (e.g., the current echo latency estimate is substantially different from the previous echo latency estimate(s)), the device 110 may output (918) the previous echo latency estimate and track the echo latency using two different techniques. Thus, the device 110 may determine (920) a primary echo latency estimate using a first technique and may determine (922) a secondary echo latency estimate using a second technique. The first technique may calculate the primary echo latency estimate differently than the second technique, such as using a different formula, a different number of previous echo latency estimates, a different weighting, and/or the like. For example, the first technique may view the difference as being temporary and may calculate the primary echo latency estimate using a first number of previous echo latency estimates (e.g., 20) corresponding to a first period of time (e.g., 1 second).

In contrast, the second technique may view the difference as indicating a permanent change and may calculate the secondary echo latency estimate without using the previous echo latency estimates. Instead, the second technique may start with the current echo latency estimate and may update the secondary echo latency estimate with subsequent estimates up to the first number (e.g., 20) of estimates corresponding to the first period of time. However, the disclosure is not limited thereto and the second technique may vary from the first technique without departing from the disclosure. For example, the second technique may include a second number of estimates corresponding to a second period of time without departing from the disclosure. Additionally or alternatively, the second technique may use a different weighting scheme than the first technique, a different formula or the like without departing from the disclosure.

At a later point in time, the device 110 may determine (924) a new echo latency estimate and may determine (926) whether the new echo latency estimate is closer to the primary echo latency estimate or the secondary echo latency estimate. For example, the device 110 may compare the new echo latency estimate to the primary echo latency estimate and to the secondary echo latency estimate to determine which estimate is more accurate. If the new echo latency estimate is closer to the primary echo latency estimate, the device 110 may increase (928) a first confidence value associated with the primary echo latency estimate and determine (930) if the first confidence value is above a second threshold value. If the first confidence value is above the second threshold value, indicating a high confidence that the primary echo latency estimate is accurate, the device 110 may output (932) the primary echo latency estimate. If the first confidence value is below the second threshold value, indicating that the device 110 is not yet confident that the primary echo latency estimate is accurate, the device 110 may loop to step 918 and repeat steps 918-932.

If the new echo latency estimate is not closer to the primary echo latency estimate than the secondary echo latency estimate (e.g., the new echo latency estimate is closer to the secondary echo latency estimate), the device 110 may increase (934) a second confidence value associated with the secondary echo latency estimate and determine (936) if the second confidence value is above the second threshold value. If the second confidence value is above the second threshold value, indicating a high confidence that the secondary echo latency estimate is accurate, the device 110 may output (938) the secondary echo latency estimate. If the second confidence value is below the second threshold value, indicating that the device 110 is not yet confident that the secondary echo latency estimate is accurate, the device 110 may loop to step 918 and repeat steps 918-938.

As illustrated in FIG. 9 and described above, after detecting a sudden change in instantaneous echo latency estimates, the device 110 may output a previous echo latency estimate until the device 110 determines whether the change is temporary or permanent. Additionally or alternatively, the device 110 may generate multiple echo latency estimates (e.g., primary/secondary echo latency estimates) and output a single echo latency estimate once the device 110 is confident that the single echo latency estimate is accurate (e.g., the primary/secondary echo latency estimate accurately tracks recent instantaneous echo latency estimates for a period of time).

Various machine learning techniques may be used to perform the training of one or models used by the device 110 to determine echo latency, select peaks or perform other functions as described herein. Models may be trained and operated according to various machine learning techniques. Such techniques may include, for example, inference engines, trained classifiers, etc. Examples of trained classifiers include conditional random fields (CRF) classifiers, Support Vector Machines (SVMs), neural networks (such as deep neural networks and/or recurrent neural networks), decision trees, AdaBoost (short for "Adaptive Boosting") combined with decision trees, and random forests. Focusing on CRF as an example, CRF is a class of statistical models used for structured predictions. In particular, CRFs are a type of discriminative undirected probabilistic graphical models. A CRF can predict a class label for a sample while taking into account contextual information for the sample. CRFs may be used to encode known relationships between observations and construct consistent interpretations. A CRF model may thus be used to label or parse certain sequential data, like query text as described above. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. For example, known types for previous queries may be used as ground truth data for the training set used to train the various components/models. Various techniques may be used to train the models including backpropagation, statistical learning, supervised learning, semi-supervised learning, stochastic learning, stochastic gradient descent, or other known techniques. Thus, many different training examples may be used to train the classifier(s)/model(s) discussed herein. Further, as training data is added to, or otherwise changed, new classifiers/models may be trained to update the classifiers/models as desired.

Figure 10:
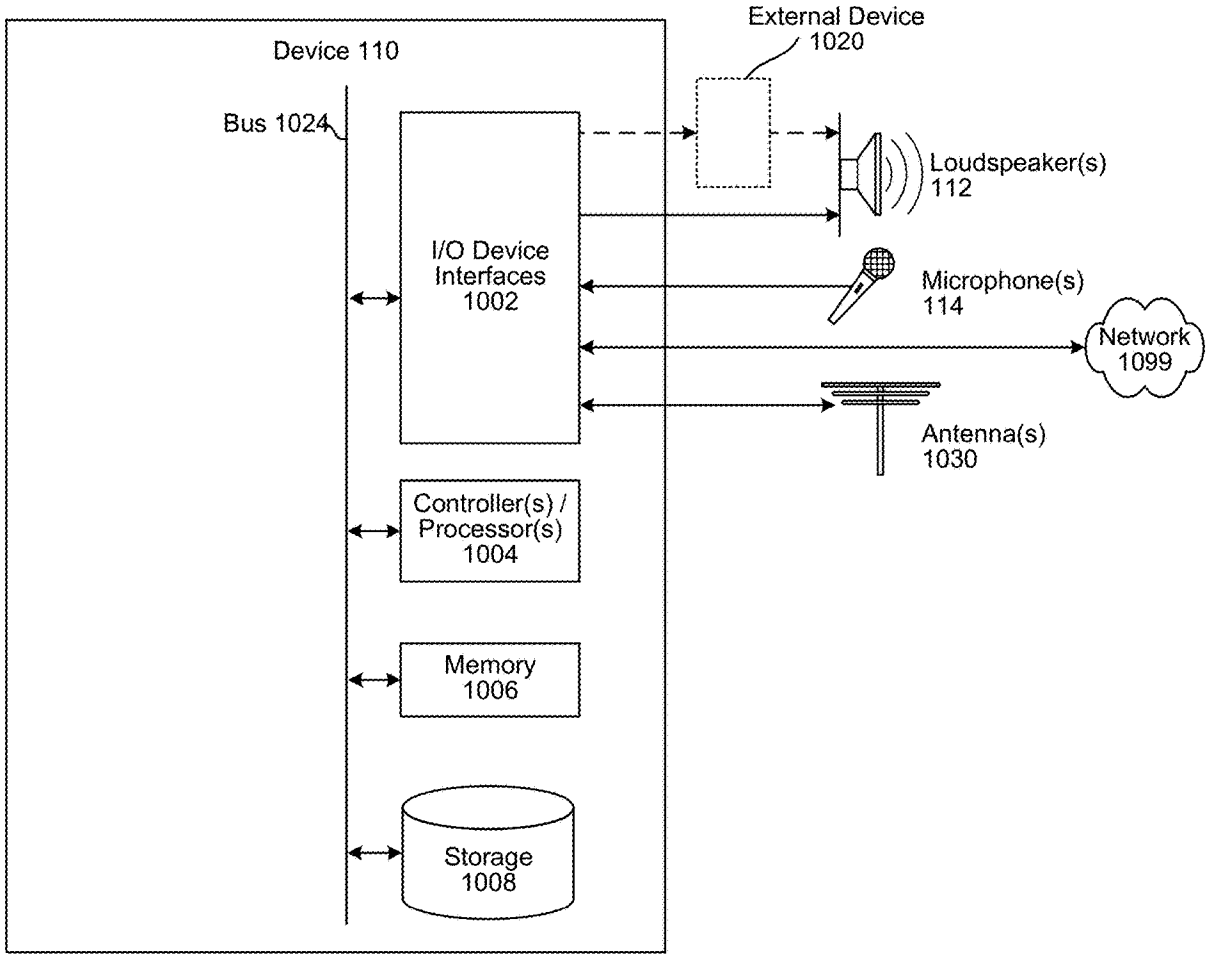
FIG. 10 is a block diagram conceptually illustrating example components of a device according to embodiments of the present disclosure.

FIG. 10 is a block diagram conceptually illustrating example components of the device 110. In operation, the device 110 may include computer-readable and computer-executable instructions that reside on the device, as will be discussed further below.

The device 110 may include one or more audio capture device(s), such as individual microphone(s) 114 and/or a microphone array that may include a plurality of microphone(s) 114. The audio capture device(s) may be integrated into a single device or may be separate. However, the disclosure is not limited thereto and the audio capture device(s) may be separate from the device 110 without departing from the disclosure. For example, the device 110 may connect to one or more microphone(s) 114 that are external to the device 110 without departing from the disclosure.

The device 110 may also include audio output device(s) for producing sound, such as loudspeaker(s) 112. The audio output device(s) may be integrated into a single device or may be separate. However, the disclosure is not limited thereto and the audio output device(s) may be separate from the device 110 without departing from the disclosure. For example, the device 110 may connect to one or more loudspeaker(s) 112 that are external to the device 110 without departing from the disclosure.

In some examples, the device 110 may not connect directly to loudspeaker(s) 112 but may instead connect to the loudspeaker(s) 112 via an external device 1020 (e.g., television 10, audio video receiver (AVR) 20, other devices that perform audio processing, or the like). For example, the device 110 may send first reference audio signals to the external device 1020 and the external device 1020 may generate second reference audio signals and send the second reference audio signals to the loudspeaker(s) 112 without departing from the disclosure. The external device 1020 may change a number of channels, upmix/downmix the reference audio signals, and/or perform any audio processing known to one of skill in the art. Additionally or alternatively, the device 110 may be directly connected to first loudspeaker(s) 112 and indirectly connected to second loudspeaker(s) 112 via one or more external devices 1020 without departing from the disclosure.

While FIG. 10 illustrates the device 110 connected to audio capture device(s) and audio output device(s), the disclosure is not limited thereto. Instead, the techniques disclosed herein may be applied to other systems to provide latency estimation and/or signal matching in a variety of circumstances. For example, the device 110 may receive input data from multiple sensors and may determine how close the sensors are to each other based on the input data. Thus, the techniques disclosed herein are applicable to systems that use RADAR techniques, SONAR techniques, and/or other technology without departing from the disclosure. For example, the device 110 may be connected to antenna(s) 1030 (e.g., one or more transmitting antenna(s), one or more receiving antenna(s), and/or one or more antenna(s) that are capable of both transmitting and receiving data) without departing from the disclosure.

The device 110 may include an address/data bus 1024 for conveying data among components of the device 110. Each component within the device may also be directly connected to other components in addition to (or instead of) being connected to other components across the bus 1024.

The device 110 may include one or more controllers/processors 1004, that may each include a central processing unit (CPU) for processing data and computer-readable instructions, and a memory 1006 for storing data and instructions. The memory 1006 may include volatile random access memory (RAM), non-volatile read only memory (ROM), non-volatile magnetoresistive (MRAM) and/or other types of memory. The device 110 may also include a data storage component 1008, for storing data and controller/processor-executable instructions (e.g., instructions to perform operations discussed herein). The data storage component 1008 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1002.

Computer instructions for operating the device 110 and its various components may be executed by the controller(s)/processor(s) 1004, using the memory 1006 as temporary "working" storage at runtime. The computer instructions may be stored in a non-transitory manner in non-volatile memory 1006, storage 1008, or an external device. Alternatively, some or all of the executable instructions may be embedded in hardware or firmware in addition to or instead of software.

The device 110 may include input/output device interfaces 1002. A variety of components may be connected through the input/output device interfaces 1002, such as the loudspeaker(s) 112, the microphone(s) 114, the external device 1020, the antenna(s) 1030, a media source such as a digital media player (not illustrated), and/or the like. The input/output interfaces 1002 may include A/D converters (not shown) and/or D/A converters (not shown).

The input/output device interfaces 1002 may also include an interface for an external peripheral device connection such as universal serial bus (USB), FireWire, Thunderbolt or other connection protocol. The input/output device interfaces 1002 may also include a connection to one or more networks 1099 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 1099, the device 110 may be distributed across a networked environment.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method comprising:

sending a first reference signal to a first loudspeaker during a first time period, the first reference signal corresponding to a first channel of a song;

sending a second reference signal to a second loudspeaker during the first time period, the second reference signal corresponding to a second channel of the song;

generating a combined reference audio signal using the first reference signal and the second reference signal;

receiving input audio data, the input audio data generated by at least one microphone, the input audio data including a first representation of first audio generated by the first loudspeaker and a second representation of second audio generated by the second loudspeaker;

determining cross correlation data corresponding to a cross correlation between the input audio data and the combined reference signal;

determining a first peak represented in the cross correlation data, the first peak corresponding to a second time period;

determining a second peak represented in the cross correlation data, the second peak corresponding to a third time period;

determining that the second time period is earlier than the third time period;

determining an echo latency estimate by determining a difference between the second time period and the first time period, the echo latency estimate indicating an amount of time between sending a reference signal and capturing audio corresponding to the reference signal;

determining, using the echo latency estimate, at least one of a step size control value, a tail length value or a reference delay value; and performing acoustic echo cancellation using at least one of the step size control value, the tail length value or the reference delay value.

2. The computer-implemented method of claim 1, wherein generating the combined reference signal further comprises:

determining a first impulse response associated with the first loudspeaker, the first impulse response corresponding to a first environment in which the first loudspeaker is located;

determining first filter coefficient values modeling the first impulse response;

generating a first filtered reference signal using the first filter coefficient values and the first reference signal;

determining a second impulse response associated with the second loudspeaker, the second impulse response corresponding to a second environment in which the second loudspeaker is located;

determining second filter coefficient values modeling the second impulse response;

generating a second filtered reference signal using the second filter coefficient values and the second reference signal; and generating the combined reference signal by combining the first filtered reference signal and the second filtered reference signal.

3. The computer-implemented method of claim 1, further comprising:

determining that a first value is a highest value in the cross correlation data, the first value corresponding to the second peak;

determining a second value that is a highest value associated with the first peak;

determining a ratio between the first value and the second value;

determining that the ratio is above a threshold value, the threshold value indicating whether the first peak is high enough to be used to determine the echo latency estimate; and determining the echo latency estimate using the second time period associated with the second value.

4. The computer-implemented method of claim 1, further comprising:

determining a first portion of the first reference signal;

determining a second portion of the first reference signal, the second portion overlapping the first portion for a duration of time;

determining second cross correlation data corresponding to a second cross correlation between the first portion and the second portion;

determining that the second cross correlation data only includes a single peak; and sending the first reference signal to the first loudspeaker.

5. A computer-implemented method comprising:

sending first audio data that corresponds to a first loudspeaker during a first time period;

sending second audio data that corresponds to a second loudspeaker during the first time period;

generating third audio data based on the first audio data and the second audio data;

receiving input audio data, the input audio data generated by at least one microphone;

determining cross correlation data corresponding to a cross correlation between the input audio data and the third audio data;

determining a first peak represented in the cross correlation data, the first peak corresponding to a second time period; and determining an estimated latency based on a difference between the second time period and the first time period, the estimated latency corresponding to a delay between sending the first audio data or the second audio data and the at least one microphone capturing audio corresponding to the first audio data or the second audio data.

6. The computer-implemented method of claim 5, wherein generating the third audio data further comprises:

determining first characteristics associated with the first loudspeaker;

determining first filter coefficient values corresponding to the first characteristics;

generating first filtered audio data using the first filter coefficient values and the first audio data;

determining second characteristics associated with the second loudspeaker;

determining second filter coefficient values corresponding to the second characteristics;

generating second filtered audio data using the second filter coefficient values and the second audio data; and generating the third audio data by combining the first filtered audio data and the second filtered audio data.

7. The computer-implemented method of claim 5, further comprising:

determining a first value that is a highest value in the cross correlation data, the first value corresponding to the first peak;

determining a second peak represented in the cross correlation data, the second peak corresponding to a third time period prior to the second time period;

determining a second value that is a highest value associated with the second peak;

determining a ratio between the first value and the second value;

determining that the ratio is below a threshold value; and determining the estimated latency based on the second time period associated with the first value.

8. The computer-implemented method of claim 5, further comprising:

determining that a first value is a highest value in the cross correlation data;

determining a second peak represented in the cross correlation data that includes the first value, the second peak corresponding to a third time period;

determining the first peak represented in the cross correlation data, the first peak corresponding to the second time period, the second time period being prior to the third time period;

determining a second value that is a highest value associated with the first peak;

determining a ratio between the first value and the second value;

determining that the ratio is above a threshold value; and determining the estimated latency based on the second time period associated with the second value.

9. The computer-implemented method of claim 5, further comprising:

determining a first number of loudspeakers to which audio data is sent during the first time period;

determining a second number of peaks in the cross correlation data, the second number equal to the first number;

determining, from the second number of peaks, a highest peak in the cross correlation data; and selecting the highest peak as the first peak.

10. The computer-implemented method of claim 5, further comprising:

determining a first portion of the first audio data;

determining a second portion of the first audio data, the second portion overlapping the first portion for a duration of time;

determining second cross correlation data corresponding to a second cross correlation between the first portion and the second portion;

determining that the second cross correlation data only includes a single peak; and sending the first audio data to the first loudspeaker.

11. The computer-implemented method of claim 5, further comprising:

determining a second estimated latency associated with a third time period;

determining a third estimated latency associated with a fourth time period;

determining a final estimated latency based on the first estimated latency, the second estimated latency and the third estimated latency;

determining, based on the final estimated latency, at least one of a step size control value, a tail length value or a reference delay value; and performing acoustic echo cancellation using at least one of the step size control value, the tail length value or the reference delay value.

12. The computer-implemented method of claim 5, further comprising:

determining a first difference between the estimated latency and a second estimated latency calculated prior to the first time period;

determining that the first difference is above a threshold value;

performing, during a third time period, acoustic echo cancellation based on the second estimated latency;

determining a primary latency estimate using the second estimated latency and the estimated latency;

determining a secondary latency estimate using the estimated latency;

determining, during the third time period, a third estimated latency;

determining a second difference between the third estimated latency and the primary latency estimate;

determining a third difference between the third estimated latency and the secondary latency estimate;

determining that the second difference is smaller than the third difference; and performing acoustic echo cancellation based on the primary latency estimate.

13. The computer-implemented method of claim 5, further comprising:

determining a first difference between the estimated latency and a second estimated latency calculated prior to the first time period;

determining that the first difference is above a threshold value;

performing, during a third time period, acoustic echo cancellation based on the second estimated latency;

determining a primary latency estimate using the second estimated latency and the estimated latency;

determining a secondary latency estimate using the estimated latency;

determining, during the third time period, a third estimated latency;

determining a second difference between the third estimated latency and the primary latency estimate;

determining a third difference between the third estimated latency and the secondary latency estimate;

determining that the third difference is smaller than the second difference; and performing acoustic echo cancellation based on the secondary latency estimate.

14. A device comprising:

at least one processor;

at least one memory including instructions operable to be executed by the at least one processor to configure the device to:

send first audio data to a first loudspeaker during a first time period;

send second audio data to a second loudspeaker during the first time period;

generate third audio data based on the first audio data and the second audio data;

receive input audio data, the input audio data generated by at least one microphone;

determine cross correlation data corresponding to a cross correlation between the input audio data and the third audio data;

determine a first peak represented in the cross correlation data, the first peak corresponding to a second time period; and determine an estimated latency based on a difference between the second time period and the first time period.

15. The device of claim 14, wherein the instructions further configure the device to:

determine first characteristics associated with the first loudspeaker;

determine a first filter corresponding to the first characteristics;

apply the first filter to the first audio data to generate first filtered audio data;

determine second characteristics associated with the second loudspeaker;

determine a second filter corresponding to the second characteristics;

apply the second filter to the second audio data to generate second filtered audio data; and generate the third audio data by combining the first filtered audio data and the second filtered audio data.

16. The device of claim 14, wherein the instructions further configure the device to:

determine a first value that is a highest value in the cross correlation data, the first value corresponding to the first peak;

determine a second peak represented in the cross correlation data, the second peak corresponding to a third time period prior to the second time period;

determine a second value that is a highest value associated with the second peak;

determine a ratio between the first value and the second value;

determine that the ratio is below a threshold value; and determine the estimated latency based on the second time period associated with the first value.

17. The device of claim 14, wherein the instructions further configure the device to:

determine that a first value is a highest value in the cross correlation data;

determine a second peak represented in the cross correlation data that includes the first value, the second peak corresponding to a third time period;

determine the first peak represented in the cross correlation data, the first peak corresponding to the second time period, the second time period being prior to the third time period;

determine a second value that is a highest value associated with the first peak;

determine a ratio between the first value and the second value;

determine that the ratio is above a threshold value; and determine the estimated latency based on the second time period associated with the second value.

18. The device of claim 14, wherein the instructions further configure the device to:

determine a first portion of the first audio data;

determine a second portion of the first audio data, the second portion overlapping the first portion for a duration of time;

determine second cross correlation data corresponding to a second cross correlation between the first portion and the second portion;

determine that the second cross correlation data only includes a single peak; and send the first audio data to the first loudspeaker.

19. The device of claim 14, wherein the instructions further configure the device to:

determining a first difference between the estimated latency and a second estimated latency calculated prior to the first time period;

determining that the first difference is above a threshold value;

performing, during a third time period, acoustic echo cancellation based on the second estimated latency;

determining a primary latency estimate using the second estimated latency and the estimated latency;

determining a secondary latency estimate using the estimated latency;

determining, during the third time period, a third estimated latency;

determining a second difference between the third estimated latency and the primary latency estimate;

determining a third difference between the third estimated latency and the secondary latency estimate;

determining that the second difference is smaller than the third difference; and performing acoustic echo cancellation based on the primary latency estimate.

20. The device of claim 14, wherein the instructions further configure the device to:

determining a first difference between the estimated latency and a second estimated latency calculated prior to the first time period;

determining that the first difference is above a threshold value;

performing, during a third time period, acoustic echo cancellation based on the second estimated latency;

determining a primary latency estimate using the second estimated latency and the estimated latency;

determining a secondary latency estimate using the estimated latency;

determining, during the third time period, a third estimated latency;

determining a second difference between the third estimated latency and the primary latency estimate;

determining a third difference between the third estimated latency and the secondary latency estimate;

determining that the third difference is smaller than the second difference; and performing acoustic echo cancellation based on the secondary latency estimate.

* * * * *